US005843344A

United States Patent [19]

Junkel et al.

[11] Patent Number: 5,843,344

[45] Date of Patent: Dec. 1, 1998

[54] PORTABLE FAN AND COMBINATION FAN AND SPRAY MISTING DEVICE

[75] Inventors: Eric E. Junkel, Des Plaines; Lee Radtke, Lake Zurich; Linda M. Usher, Chicago, all of Ill.

[73] Assignee: Circulair, Inc., Niles, Ill.

[21] Appl. No.: 808,402

[22] Filed: Feb. 28, 1997

Related U.S. Application Data

[63] Continuation-in-part of Ser. No. 516,388, Aug. 17, 1995, Pat. No. 5,620,633.

[51] Int. Cl.[6] ..... B01F 3/04

[52] U.S. Cl. ..... 261/28; 239/222.11; 239/289; 261/78.2; 261/89

[58] Field of Search ..... 239/77, 289, 222.11, 239/351, 355, 600; 261/28, 78.2, 89, 90

[56] References Cited

U.S. PATENT DOCUMENTS

| | | | |
|---|---|---|---|
| D. 178,144 | 6/1956 | Miller . | |
| D. 220,246 | 3/1971 | Pacelli . | |
| D. 264,181 | 5/1982 | Booso . | |
| D. 292,556 | 11/1987 | Daugherty . | |
| D. 349,570 | 8/1994 | Radtke, Jr. . | |
| 1,993,635 | 3/1935 | Towt | 261/28 |
| 2,736,606 | 2/1956 | Kmiotek . | |
| 3,997,115 | 12/1976 | Licudine | 239/222.11 |
| 4,523,080 | 6/1985 | Bolton . | |
| 4,700,494 | 10/1987 | Pridgen . | |
| 4,839,106 | 6/1989 | Steiner . | |
| 5,082,177 | 1/1992 | Hill et al. | 239/77 |
| 5,338,495 | 8/1994 | Steiner et al. . | |
| 5,620,633 | 4/1997 | Junkel et al. | 261/90 |
| 5,667,731 | 9/1997 | Junkel et al. | 261/90 |
| 5,667,732 | 9/1997 | Junkel et al. | 261/28 |
| 5,715,999 | 2/1998 | Hsu | 239/222.11 |

*Primary Examiner*—C. Scott Bushey
*Attorney, Agent, or Firm*—Gifford, Krass, Groh, Sprinkle, Patmore, Anderson & Citkowski, P.C.

[57] ABSTRACT

A combination portable fan and spray misting device for creating a cooling atomized mist spray. The fan includes an elongated body portion and a fan blade head portion which is attached in an upwardly and angled fashion relative to the body portion and which further includes a rotatable fan blade unit. The spray misting device furter includes a body containing a volume of a liquid and a spray applicator secured atop said body and capable of issuing an atomized fluid mist spray of the liquid in a direction from the rear of and both above and through the rotating fan blade unit to further cool, atomize and distribute the spray in a desired application.

15 Claims, 7 Drawing Sheets

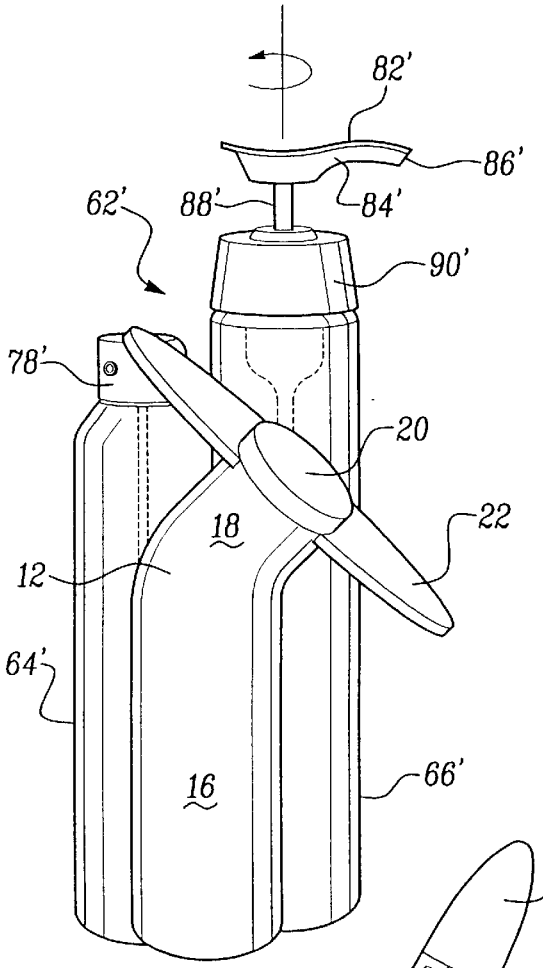
Fig–8A
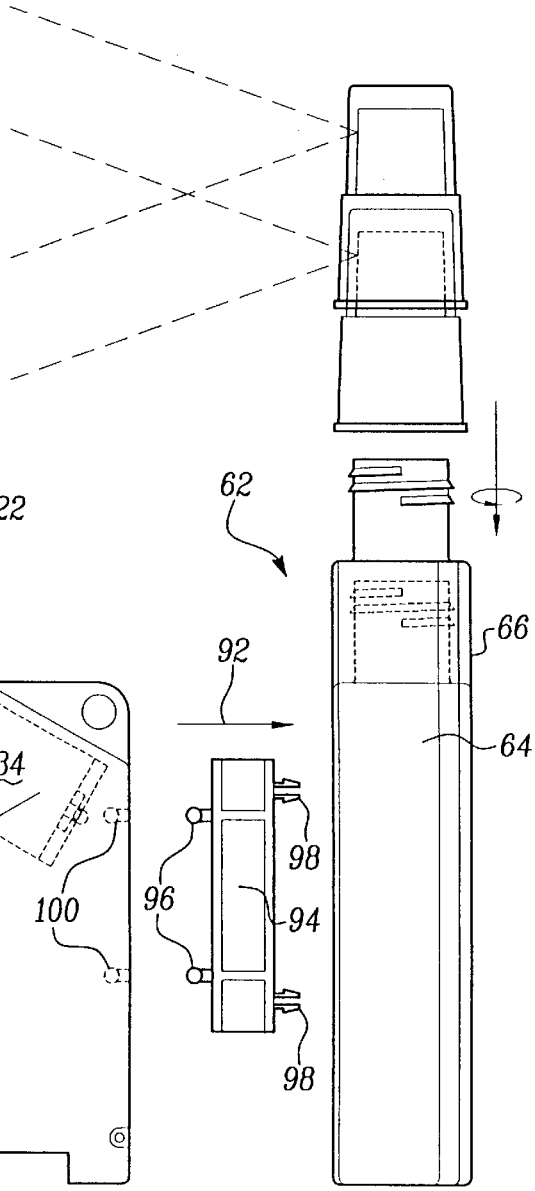
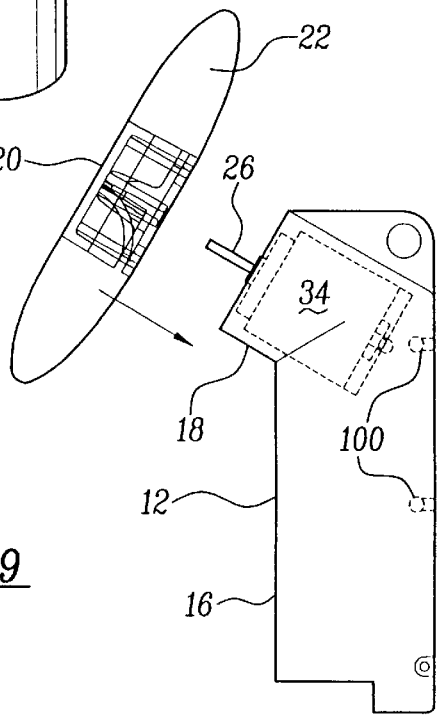
Fig–9
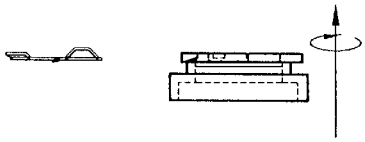

PORTABLE FAN AND COMBINATION FAN AND SPRAY MISTING DEVICE

CROSS-REFERENCE TO RELATED APPLICATIONS

The present application is a continuation-in-part of application U.S. Ser. No. 08/516,388, filed Aug. 17, 1995, issued Apr. 15, 1997 as U.S. Pat. No. 5,620,633 for a Spray Misting Device for use with a Portable-Sized Fan.

BACKGROUND OF THE INVENTION

1. Field of the Invention

The present invention relates generally to misting devices and, more specifically, to a novel portable fan and combination fan and spray misting device for producing a cooling atomized mist spray.

2. Description of the Prior Art

Portable cooling and misting devices which are used by sunbathers and others involved in athletic activities are fairly well known in the art. The concept of such devices is to provide a cooling current of air, either alone or in combination with an atomized liquid mist, such as water, to combat the elements of heat and dehydration attendant with athletic activities and/or prolonged exposure to the sun.

Copending application U.S. Ser. No. 08/516,388, now U.S. Pat. No. 5,620,633 discloses a spray misting device for use with a portable-sized fan for creating a cooling atomized mist spray which includes a battery powered stand alone fan device having a predetermined outline and thickness with a front and a rear and which encloses a fan blade unit. The spray misting device includes a body with a hollow interior which is capable of holding a predetermined volume of liquid and an applicator for providing an atomized mist spray of the liquid. A clip assembly is provided for detachably securing the spray misting body to the rear of the fan unit so that the applicator is located in proximity to the fan blade unit. The applicator generates an atomized mist spray which is delivered from above and in a direction of the fan blade unit which creates a current of air to cool the mist spray and to deliver it to a user thereof. The device is capable of being used as a combination fan and misting device or as either a misting device or fan separably as is desired by the user.

U.S. Design Pat. No. 349,570, issued to Radtke, Jr., discloses a portable electric powered fan which is capable of being easily carried on a person and which is battery powered for delivering a cooling stream of air at any remote location without the need for cords or electrical outlets. U.S. Pat. No. 5,338,495, issued to Steiner et al., teaches a portable misting fan device having an integral portable fan and atomizing head unit which includes electrical power means for operating the fan unit and which forms a portable cooling unit. The head unit is attached by a screw-type connector to a threaded neck bottle commonly used with piston sprayers. A trigger is positioned upon the head unit and, upon being depressed, withdraws fluid from the bottle through a tube extending downwardly from the head unit into the bottle and discharges the fluid toward the rear lower faces of the rotating blades of the fan blade unit where they impact against the forwardly curved faces and are subsequently dispersed in a mostly forward direction.

SUMMARY OF THE PRESENT INVENTION

The present invention is a novel portable fan and combination fan and spray misting device for creating a cooled and atomized spray mist in which the fan includes an elongated body portion and a rotating fan blade head portion extending upwardly and in an angled fashion relative to the body portion. The spray misting device has a likewise elongated and liquid carrying body and an applicator means including a nozzle for issuing the liquid in an atomized mist spray. In each of the preferred embodiments, the elongated fan body is releasably secured to a front face of the spray misting device body so that the nozzle is positioned above the fan elongated body and rearwardly of the upwardly angled fan blade head unit.

According to a first preferred embodiment, the portable fan is formed as a generally elongated body and the spray misting device as a single elongated body having a flattened frontal face and a push button nozzle at a top end. At least a first and a second bulbous shaped tab projects forwardly from the frontal face of the misting device and both are received within like configured apertures in an associated rear face of the fan body for detachably securing the fan body in place.

In a further preferred embodiment, the misting device is provided as first and second elongated fluid carrying chambers which are secured together along a substantially narrow and elongated webbed connection. In one variant, bulbous shaped projecting tabs extend from the front faces of the fluid carrying chambers and are secured within rotatably configured slotted members in a rear face of the fan body. The fan body is rotated slightly with respect to the dual fluid carrying chambers so that the tab portions are rotated to a slightly narrowed portion of the slotted members to lock the fan in place. According to a further variant, an intermediate clip portion having both forwardly and rearwardly projecting connections which secure respectively within apertures formed in the webbed connection of the fluid carrying chambers and apertures in an associated rear face of the fan body.

According to a yet further preferred embodiment, the spray misting device is constructed as a conventional spray bottle with a relatively large body and a spray head secured over an opening located at a top of the body by a threaded and rotating collar. The portable fan is constructed of a substantially cylindrical and elongated body which houses a portable electrical supply, such as a pair of batteries, and further includes a flexible elongate neck which terminates in a fixedly repositionable fan blade head unit. The body of the portable fan includes recessed portions which are capable of being engaged by projecting tabs extending from the spray bottle body for securing to the fan in such a manner as to permit the fan blade head unit to be positionable and repositionable in an upwardly angled fashion and is capable of being used together with spray misting device or separately as is desired.

BRIEF DESCRIPTION OF THE DRAWINGS

Reference is now made to the attached drawings, when read in combination with the following specification, wherein like reference numerals refer to like parts throughout the several views, and in which:

FIG. 8*a* is a modification of the combination portable fan and dual fluid enclosure device according to the present invention.

FIG. 9 is a side exploded view similar to that illustrated in FIG. 6 and showing the combination portable fan and spray misting device according to the embodiment of FIG. 8;

DETAILED DESCRIPTION OF THE PREFERRED EMBODIMENTS

Figure 1:
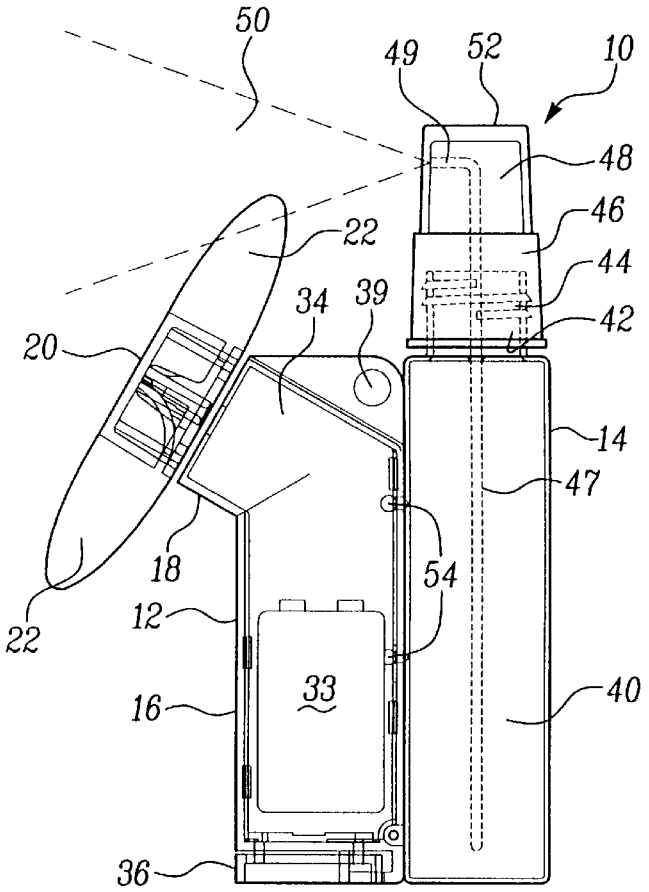
FIG. 1 is a side view of the combination portable fan and spray misting device according to a first preferred embodiment of the present invention.
Figure 2:
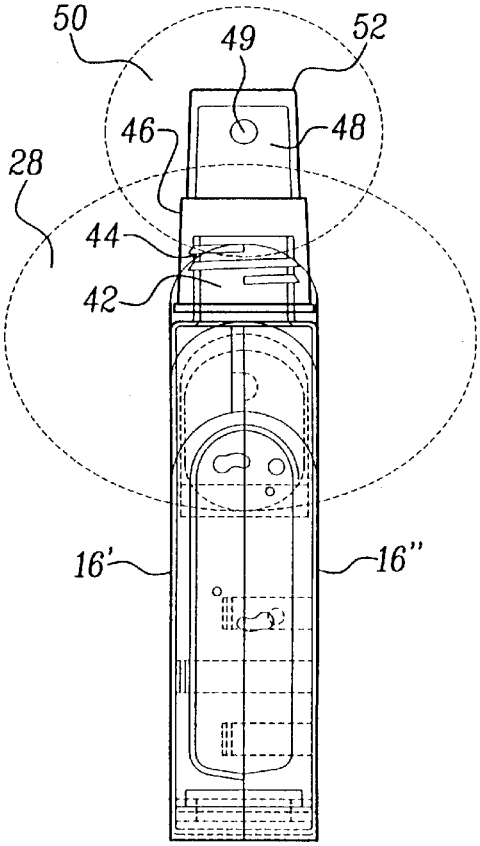
FIG. 2 is a rear view of the combination portable fan and misting device illustrated in FIG. 1 and illustrating a diametrical overlap of the paths of the atomized spray mist and angularly oriented and rotating fan blade head portion.
Figure 3:
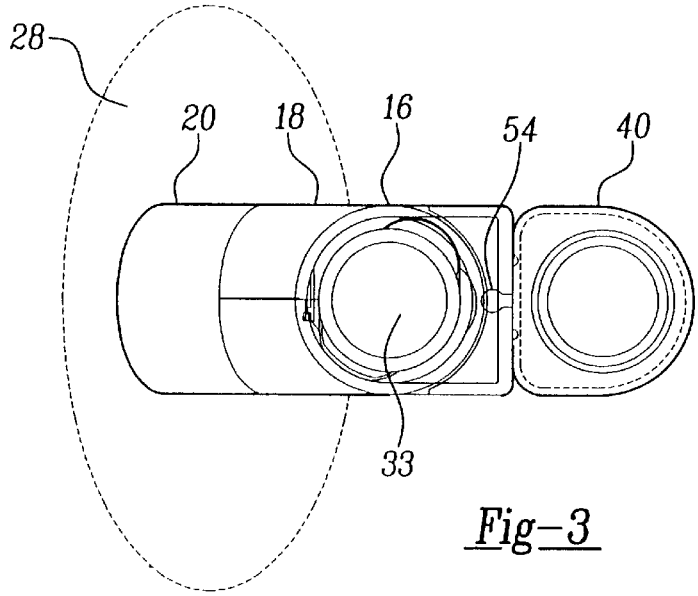
FIG. 3 is a bottom view of the combination portable fan and misting device according to the embodiment illustrated in FIGS. 1 and 2.

Referring now to FIGS. 1–3, a combination fan and spray misting device 10 is shown according to a first preferred embodiment of the present invention and includes a fan portion 12 and a misting device portion 14. Both the fan portion 12 and misting device portion 14 are preferably constructed of a durable plastic or the like and, as is also illustrated in FIGS. 4, 5 and 7, the fan portion 12 includes an elongated body portion 16 and an integrally formed and upwardly angularly extending head portion 18 to which is attached a rotating fan blade unit 20 incorporating a plurality of individual fan blades 22.

Figure 4:
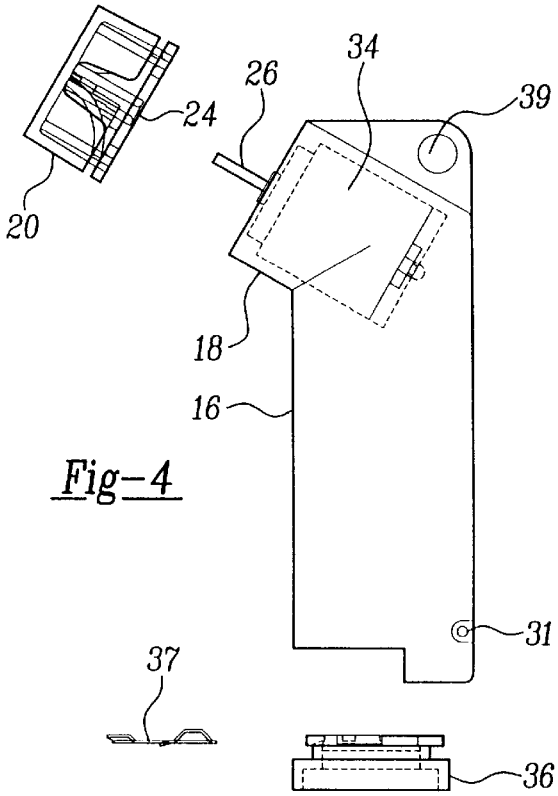
FIG. 4 is a side exploded view of the portable fan according to the first preferred embodiment.

Referring specifically to FIG. 4, the body of the fan blade unit 20 includes a longitudinally extending apertured portion, indicated as a bore 24 in the impeller hub, which receives a rotating shaft portion 26 extending from the upwardly angularly extending head portion 18. The individual fan blades 22 are further preferably constructed of a smooth edged and flexible rubber or plastic material and, as is best illustrated in FIGS. 2 and 3, define a first diametrical blade path 28.

Figure 5:
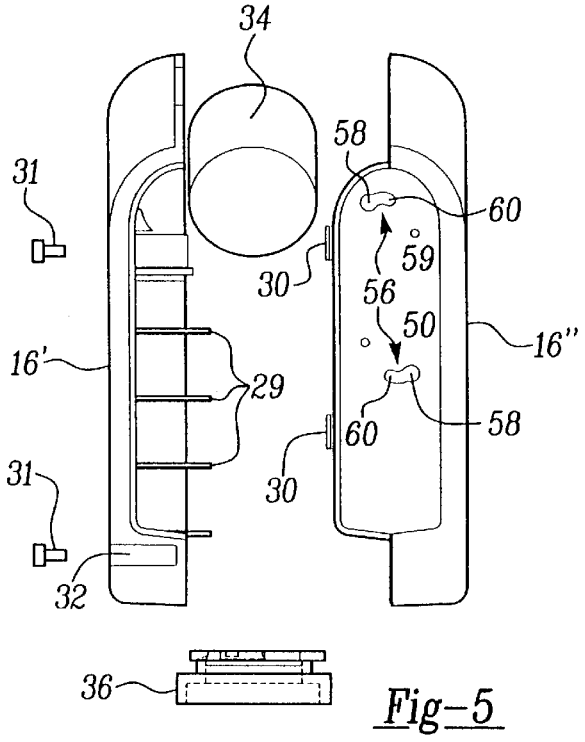
FIG. 5 is a rear exploded view of the portable fan as illustrated in FIG. 4.
Figure 6:
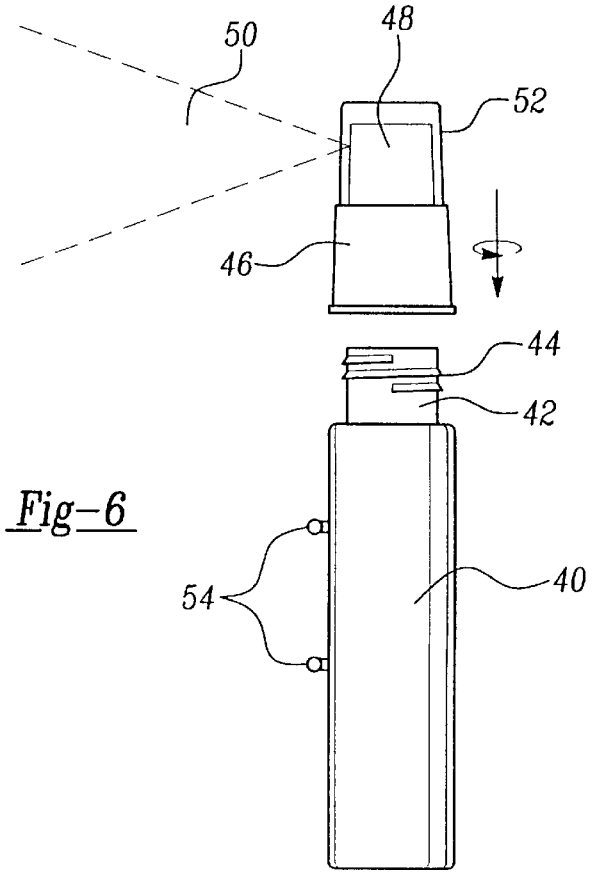
FIG. 6 is a side exploded view similar to that shown in FIG. 4 and further illustrating the spray misting device and the releasably engaging means for securing the misting device to the portable fan.
Figure 7:
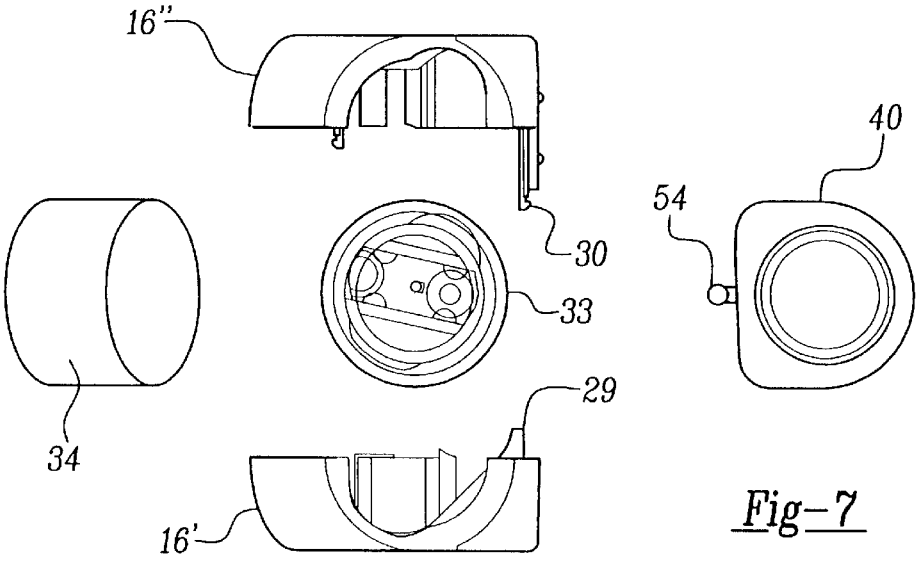
FIG. 7 is a bottom exploded view of the portable fan and spray misting device illustrated in FIG. 6.

According to one preferred embodiment, the fan's elongated body portion 16 is illustrated in exploded view in FIGS. 5 and 7 and includes a first elongated half portion 16' and a second elongated half portion 16". The half portions 16' and 16" are assembleable together in alignment by a plurality of ribbed portions 29 (FIG. 5) extending from the half portion 16' which align with respective apertured portions in the half 16". The half portion 16" includes gripping tabs 30 which facilitate assembly and disassembly of the portions 16' and 16" and, as is best shown in FIGS. 4 and 5, fasteners 31 are insertable within apertures 32 formed in the half portion 16' and engage the half portion 16" to secure the halves together. Upon assembly, the halves 16' and 16" define a cavity therebetween sufficient for holding a single or double conventional "AA" sized alkaline batteries 33.

The fan 12 also includes a portable electric motor 34 which is situated within the upwardly angled head portion 18 and in electrical communication with the batteries 33. A base of the rotating shaft portion 26 is mounted within the electric motor 34 and rotatably drives the shaft 26 which extends from the angled head portion 18. As is best shown in FIGS. 4 and 5, a cap portion 36 is securable to an open bottom of the fan body 16 and closes the body 16 once the batteries are inserted. The cap portion 36 preferably includes an internally configured spring contact portion 37 and is rotated so that the contact portion 37 is aligned in position with a pair of terminals to engage the internally carried battery in continuous electrical contact with the portable electric motor 34.

An on/off button for activating and deactivating the portable fan may preferably be incorporated into the bottom engaging cap portion 36 and is engaged by rotating the cap portion from a first off position to a second on position as is evident by the arrow 38 in FIG. 1. An alternatively shaped on/off button (not shown) or the like can be emplaced anywhere upon the fan body which is easily reachable by a user and is in electrical communication with the battery and electric motor attachment as is desired. As is best seen in FIGS. 1 and 4, an aperture 39 may be formed within an upper corner of the fan body 16 and is particularly useful for receiving a rope, chain or the like (not shown) for permitting the fan device 12 to be suspended around a wearers neck, with or without attachment of the misting device 14 as will be subsequently described.

The misting device portion 14 includes an elongated and internally hollowed body 40 and an open neck portion 42 at an upper end thereof. The neck portion 42 is externally threaded at 44 and receives a screw cap 46 with interengaging and internally placed threads (not shown) so as to secure the cap 46 atop the misting device 14. A fluid withdrawing tube portion 47 or the like extends downwardly from the screw cap 46 into the open interior of the body 40 and acts to withdraw a desired fluid held within the body, such as water, suntan lotion and the like, upon the downward depression of a push button portion 48 mounted atop the screw cap 46. A passageway 49 is formed in the portion 48 in communication with the withdrawing tube portion 47 and, upon downward depression of the button portion 48, distributes an atomized mist spray along a second diametrical path 50 which, as illustrated in FIG. 2, overlaps with the first diametrical blade path 28 of the fan blades 22.

A non-use and storage cap portion 52 is releasably securable over the push button portion 48 and the body portion 40 of the misting device 14 further includes a pair of substantially bulbous end shaped and forwardly projecting portions 54 which are vertically spaced apart along an associated forward vertical face of the misting device body 40 and which engage within associating negative apertured portions formed in a rear face of the fan body 16. The bulbous end shaped portions 54 are illustrated in operative engagement in FIGS. 1–3 and it is evident that the contours of the apertures as subsequently described are such that the bulbous shaped portions are twisted and snapped into place to mount the misting device to the rear of the fan body.

Referring to FIG. 5, the primary means for attaching the misting device 14 to the fan portion 12 is provided by a pair of rotatably configured and slotted members 56 formed on a substantially flattened and rear face of the fan body 12. Each of the slotted members 56 includes a first width portion 58 through which is inserted the bulbous portions 54, a second narrowed width portion 59 and a third further narrowed portion 60 so that, upon alignment of the bulbous end shaped portions extending from the misting device 14, the fan device 12 is rotated to engage the interconnecting neck portions of the bulbous end portions 54 within the progressively constructed and narrowed width portions and to thereby releasably engage the misting device to the fan body.

Referring now to FIGS. 8–11, a combination portable fan and misting spray device 62 is illustrated according to a yet further preferred embodiment of the present invention and incorporates all of the operative features of the fan body 12 substantially as described with reference to FIGS. 1–7. The embodiment 62 of FIGS. 8–11 differs from the initially disclosed embodiment in that the single fluid carrying misting device container is replaced by a pair of first 64 and second 66 fluid carrying containers which extend in a generally elongated and parallel manner and which are interconnected by an elongated webbed connection 68.

Figure 8:
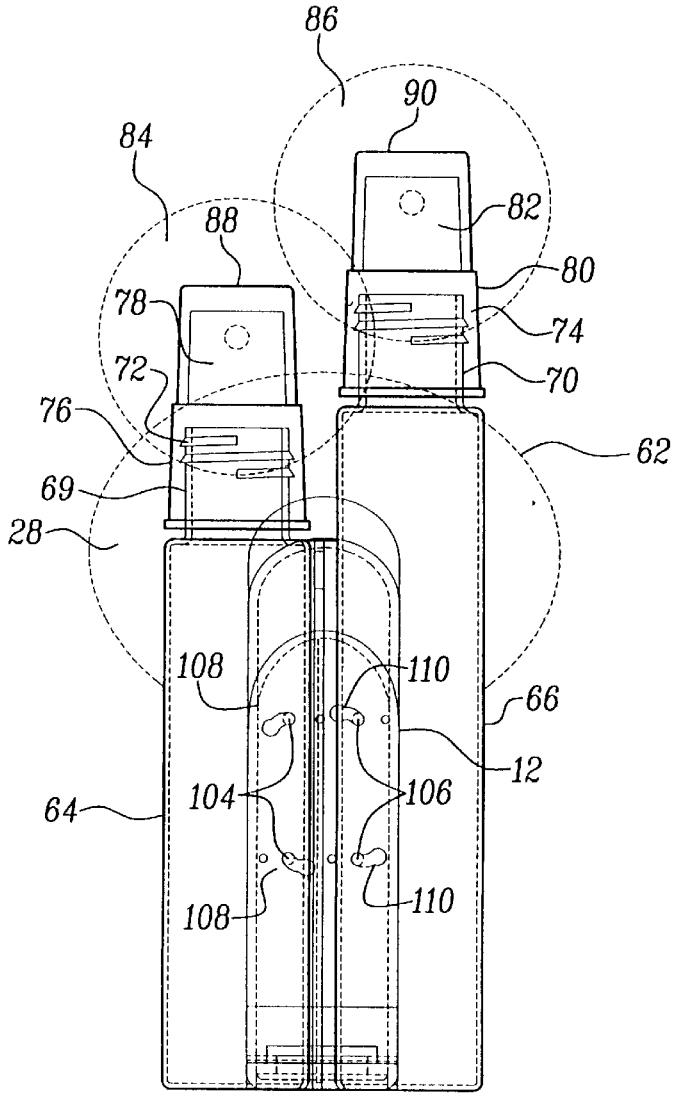
FIG. 8 is a rear view of the combination portable fan and dual fluid enclosure spray misting device according to a further preferred embodiment of the present invention.

As is best illustrated in FIG. 8, the first fluid carrying container 64 terminates in a neck portion 69 and the second fluid carrying container 66 in a likewise neck portion 70 similarly as disclosed in the misting device 14 according to FIGS. 1–7. Interengaging threads 72 are provided on the open neck portion 69 and similar threads 74 on the neck portion 70 to facilitate the screw attachment of screw caps. Specifically, a first screw cap 76 upon which is mounted a first push button portion 78 is attached to the first fluid carrying container 64 and a second screw cap 80 upon which is mounted a second push button portion 82 is attached to the second fluid carrying container 66.

The push button portions 78 and 82 are operable either separably or in tandem to create first and second diametrical spray patterns 84 and 86, respectively, in relationship to the diametrical blade path 28 of the fan blade portion 20 as previously described. The fluid carrying containers are otherwise actuable similarly as described in the first preferred embodiment and the atomized mist spray, upon contacting the turbulent air currents generated by the fan blade unit 20, create a cooled and further atomized mist spray for any desired application. Non-use and storage cap portions 88 and 90 are provided and attach over the push button portions 78 and 82 similarly as previously described.

Referring to FIG. 8*a*, a modification 62' is shown of the combination portable fan and spray misting device and differs from the embodiment 62 in that a first 64' of the fluid carrying containers is similar to the container 64 previously described having a spray pump 78' and a second 66' of the containers is provided which is taller and includes a lotion applicator 82'. The applicator 82' includes a contoured head portion 84' with an applicating nozzle 86' and a downwardly depressible tube 88' secured within a rotatable locking collar 96'. The modification 62' of the further preferred embodiment is intended to permit the user to apply a water or similar cooling fluid in an atomized manner within the fluid carrying container 64' while further permitting a suntan lotion, moisturizing cream or similar conventional viscous substance to be contained within the container 66'. The applicator 82' is further capable of being rotated in the direction indicated by the arrow to enable the user to apply the lotion to the side of the fan blade unit 20.

Figure 10:
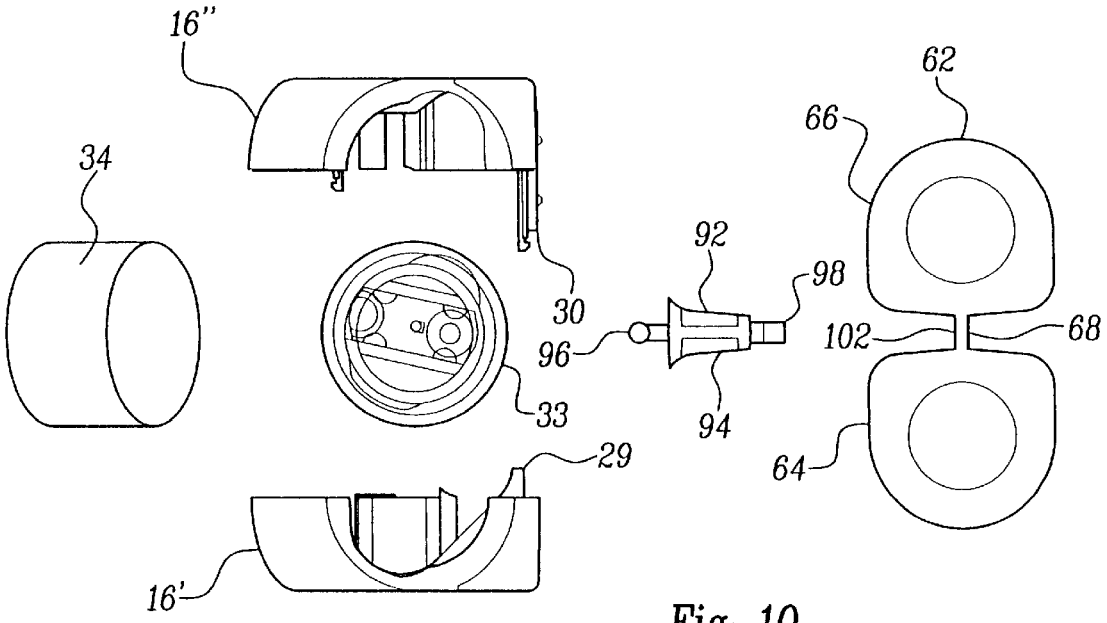
FIG. 10 is a bottom exploded view of the fan and spray misting device of FIG. 8 and 9.
Figure 11:
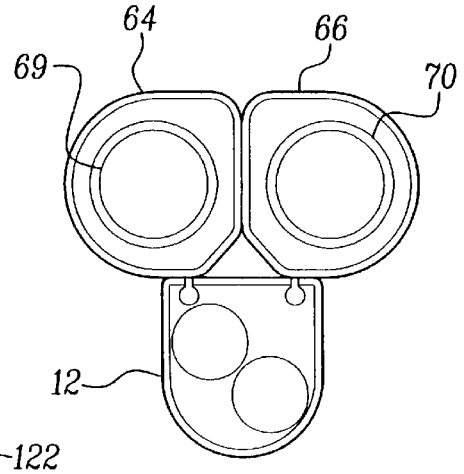
FIG. 11 is a top view of an alternative variant of the double spray misting bottle design.

As is best illustrated in FIGS. 9 and 10, an intermediate clip portion 92 may be provided according to one further preferred variant for releasably securing the dual spray bottle attachments 64 and 66 to the portable fan device 12. The clip portion 92 includes an elongated body portion 94 as is illustrated in side and cross sectional view in FIGS. 9 and 10, respectively, and further includes a plurality of bulbous end shaped and forwardly extending portions 96 as well as first and second pairs of laterally deflectable engaging portions 98 extending rearwardly from the body portion 94. A pair of internally configured apertures 100 are formed in a rear face of the fan body 12 as shown in FIG. 9 and are aligned with the spacing between the bulbous end shaped portions 96 to permit the clip portion 92 to be snappingly engaged to the fan body 12. As is further shown in cross section according to FIG. 10, apertures (illustrated by aperture 102) may be formed in the webbed connection 68 in a like spaced apart manner to permit the pairs of laterally deflectable engaging portions to engage the misting bottle arrangement.

As is also shown in the frontal view partially in phantom, according to FIG. 8, a first pair of bulbous end shaped projecting portions is illustrated at 104 projecting from the first fluid carrying container 64 and a second pair of like shaped portions is illustrated at 106 projecting from the second fluid carrying container 66 each in similar fashion as described in the first preferred embodiment according to FIGS. 1–7. The portable fan 12 is illustrated substantially in phantom so that additional pairs of rotatably configured slot members 108 and 110 which correspond in arrangement with the bulbous end shaped portions 104 and 106 are illustrated and which permit the spray misting device to be rotatably and releasably engaged with the fan body in similar fashion as previously described. The further preferred embodiment of FIGS. 8–11 provides a useful two bottle construction to permit both the application of a greater volume of atomized spray as well as the ability to apply the spray at different degrees of inclination relative to the path of the rotating fan blades 22.

Figure 12:
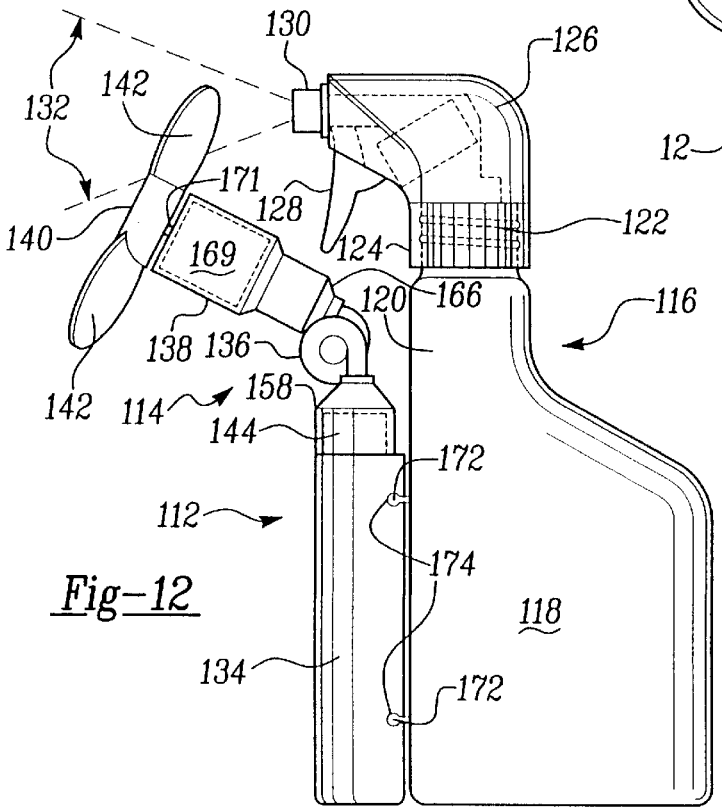
FIG. 12 is a side view of the combination portable fan and spray misting device according to a still further preferred embodiment of the present invention.

Referring now to FIG. 12, a combination fan and spray misting device 112 is illustrated according to the further preferred embodiment of the present invention and includes a portable fan body portion 114 and a misting device portion 116. The misting device 116 according to this further preferred embodiment is for the most part a well known spray device for applying such items as window cleaner, wood polishing liquid and the like and it is envisioned that any such commonly available spray misting device as is known in the art can be incorporated for use with the fan 114 as will be subsequently described.

The misting device portion 116 includes a body 118 which is internally hollowed and terminates in an upwardly extending and narrowed portion 120 which in turn terminates in an externally threaded neck portion 122. A rotatable screw cap 124 is attachable over the neck portion 122 of the body 118 and further includes a spray head portion 126 which is disposed above the body 118 of the misting device 116. A depressible trigger portion 128 is operatively connected to the spray head portion 126 and, upon being actuated, issues from a nozzle portion 130 a spray mist pattern 132 according to the desired fluid contents of the container body 116.

Figure 20:
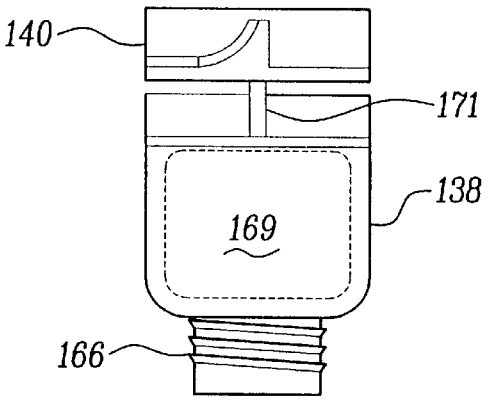
FIG. 20 is a view of a fan motor hub forming a part of the fan blade head portion according to the further preferred embodiment of the present invention.
Figure 21:
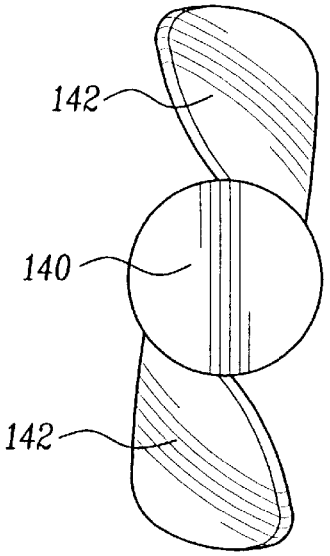
FIG. 21 is a frontal view of a fan blade head unit which is rotatably engaged with the head portion according to the further preferred embodiment of the present invention.

The portable fan body portion 114 includes an elongated body and battery carrying compartment 134, a generally upwardly extending and flexible/repositionable elongated neck portion 136, a fan head portion 138 and a rotating blade portion 140 upon which is arrayed a plurality of individual fan blades 142 (see also FIG. 21). The function of the specific components of the fan body portion 114 will now be explained with reference to the furthering FIGS. 15–21 as will now be described.

Figure 15:
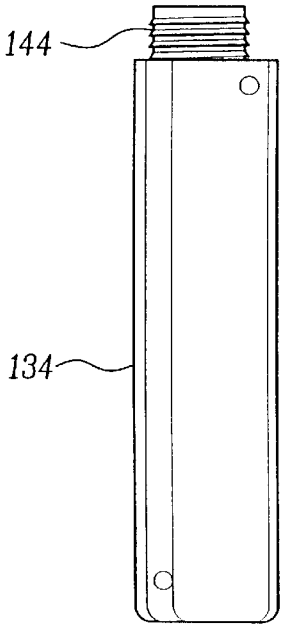
FIG. 15 is a side view of a body of the portable fan enclosure according to the further preferred embodiment of FIG. 12.
Figure 16:
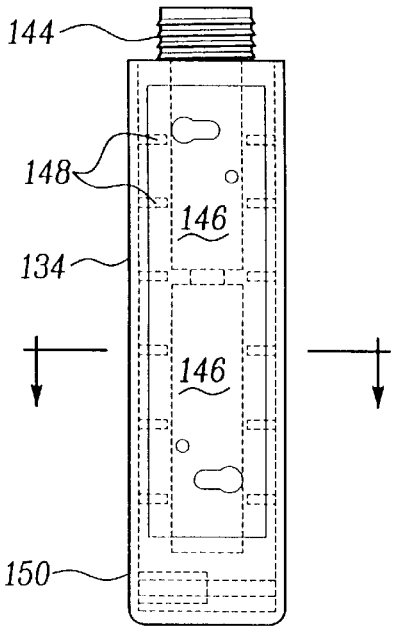
FIG. 16 is a view similar to that illustrated in FIG. 15 and further showing in phantom an internal view of the portable fan body.
Figure 17:
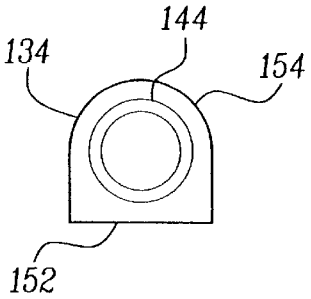
FIG. 17 is a top view of the portable fan enclosure illustrated in FIGS. 15 and 16.

Specifically, with reference to FIGS. 15–17, the elongated body and battery carrying compartment 134 includes an elongated cylindrical and generally hollow portion which terminates in an upwardly extending and reduced diameter neck portion 144, the neck portion 144 including a plurality of externally arrayed threads for engaging the elongated and repositionable flexible neck portion 136 as will be subsequently described. As is illustrated in the phantom view of FIG. 16, a pair of batteries 146, ideally AA alkaline batteries, are held within the hollow interior cavity formed within the fan body 134 and are maintained in a centralized area of the body interior by a plurality of inwardly extending locator ribs 148 which are arranged at spaced apart locations along the height of the body interior. The batteries 146 are easily inserted axially through the neck portion 144 and are situated so as to be in electrical communication with the flexible neck portion 136 and are situated at a predetermined axial height by virtue of a spring electrical contact 150 positioned in a base of the body interior cavity. The contact 150 serves the dual purpose of completing an electrical circuit and exerting force against the batteries so that raised parts 151 hold their position and maintain good contact. As is also shown upon reference to FIG. 17, the body 134 of the portable fan device includes a flattened face 152 and a rounded face 154 for facilitating attachment to the spray bottle body 118.

Figure 18:
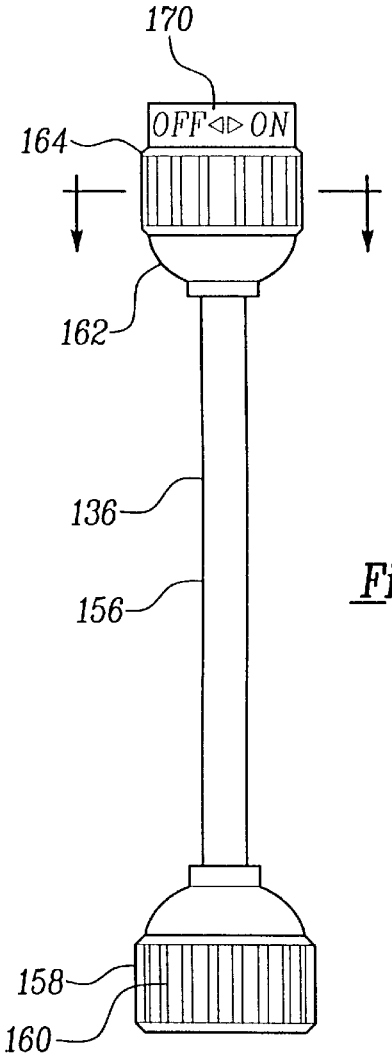
FIG. 18 is a view of the intermediate flexible neck portion which is attachable to the portable fan body as illustrated in FIG. 12 according to the further preferred embodiment of the present invention.
Figure 19:
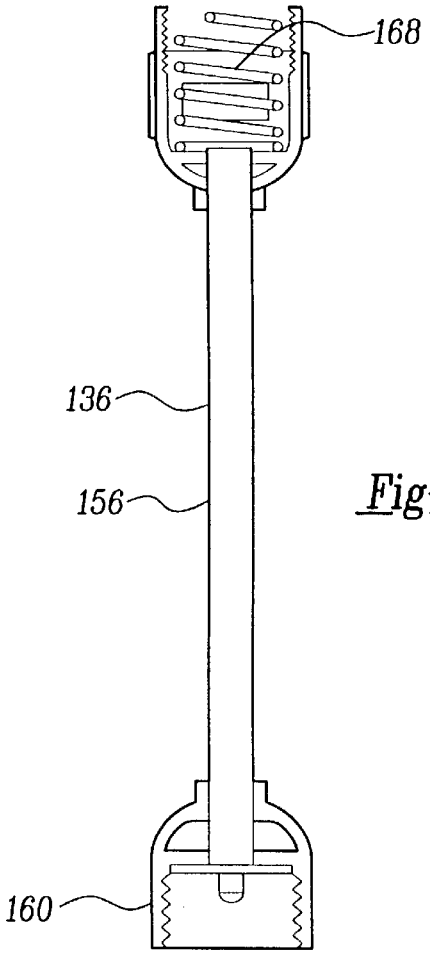
FIG. 19 is a view similar to that shown in FIG. 18 and further illustrating in phantom first and second attachment ends of the intermediate flexible neck portion according to the further preferred embodiment of the present invention.

Referring now to FIGS. 18 and 19, the elongated flexible and repositionable neck portion 136 includes an elongated member 156 which terminates in a first end in fan body attaching portion 158 and includes a rotatable collar portion 160 with internally positioned threads (not shown) which secures over the threads of the neck portion 144 of the fan body 134 to secure the elongated neck portion 144 to the body 134 of the fan. The elongated member 156 is preferably constructed of either a rubberized or plastic material and incorporates an internal deformable structure as is known in the art to facilitate fixed repositioning of the member 136 and further includes electrical communicating means which are operable to draw power from the batteries located in the body 134 and transmit it to the fan head portion 138.

The elongated member 156 terminates in a second end in a fan head attaching portion 162 and includes a further rotating collar 164. Referring to FIG. 20, the fan head portion 138 includes a reduced diameter neck portion 166 with externally placed threads which receives the rotating collar 164 to securely position the fan head 138 to the end of the elongated flexible neck portion 136. As is also shown upon reference to the phantom view of FIG. 19, a further coil spring 168 is positioned within an open interior of the attaching portion 162 and facilitates the electrical contact with the fan head portion 138. A portable electric motor 169 is incorporated into the fan head portion 138 as is illustrated in phantom and further includes a rotatably driven shaft portion 171 which supports the blade driving portion 140 as shown. As is also illustrated in FIG. 18, an on/off switch 170 is incorporated into the rotating collar assembly 164 and, upon a slight degree of rotative movement, selectively activates and deactivates the fan head portion 138.

Figure 13:
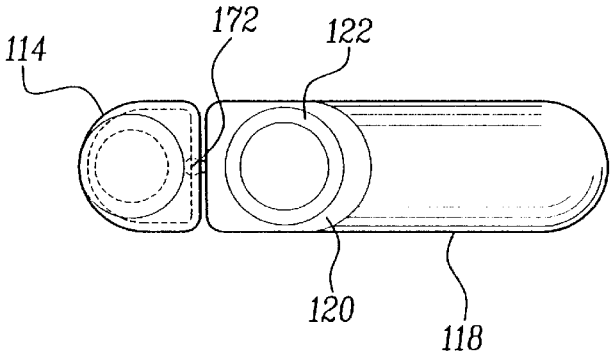
FIG. 13 is a top view of the further preferred embodiment according to FIG. 12 illustrated without the sprayer head or fan blade unit.
Figure 14:
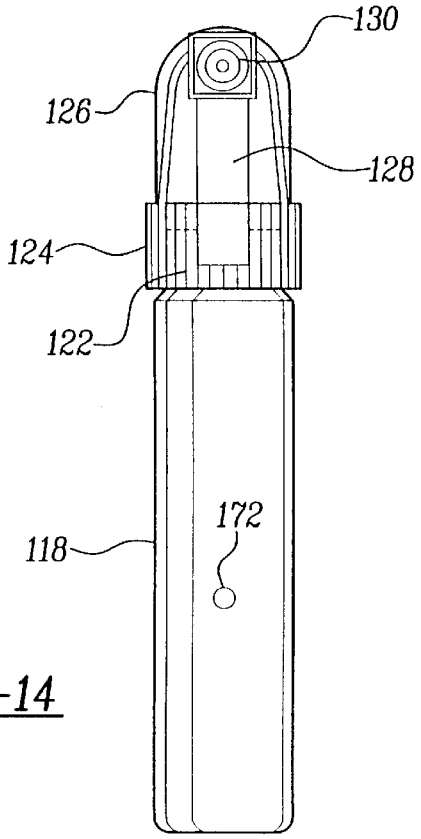
FIG. 14 is a frontal view the spray misting device according to the further preferred embodiment of FIG. 12.

Referring once again to FIGS. 12 and 13, a pair of bulbous end shaped portions 172 project forwardly from the body 118 of the spray bottle 116 and are received in like configured apertures 174 in associated spaced apart locations in a rear face of the fan elongated body 134. The portable fan assembly 114 is therefore attachable to the spray bottle 116 in a manner so as to permit the fan head portion to be repositionable relative to the spray applicating head of the bottle and to optimize the application of the atomized mist 132. The fan assembly 114 is also capable of being used separately from the spray bottle 116 such as being placed in an upstanding position.

The present invention therefore discloses a novel combination portable fan and spray misting device which facilitates application of a cooled atomized mist spray for many applications. Additional embodiments will become apparent to those skilled in the art to which it pertains without deviating from the scope of the appended claims.

We claim:

1. A combination fan and spray misting device for creating a cooling atomized mist spray, comprising:

said fan including an elongated body portion and a head portion connected to said body portion and extending in an upwardly and angled manner relative to said body portion;

said head portion including a plurality of rotatable blade elements mounted thereto;

said misting device having a body containing a volume of a liquid and an applicator means located atop said body and including a nozzle for supplying said liquid in said atomized mist spray; and releasable securing means for mounting said fan body to a front face of said misting device body so that said nozzle is positioned above said fan elongated body and rearwardly of said upwardly angled fan blade head portion;

whereby said atomized mist spray is cooled and distributed to a user by air currents generated by said fan head portion.

2. The combination fan and spray misting device according to claim 1, said fan further comprising an upwardly and angularly extending portion interconnecting with said elongated body portion, said fan blade head portion being rotatably secured to said angularly extending portion, said elongated body portion and upwardly extending portion being constructed of a durable plastic material.

3. The combination fan and spray misting device according to claim 1, said releasable securing means further comprising at least one pair of bulbous end shaped portions projecting forwardly from said body of said misting device and at least one pair of like configured apertures formed in an abutting face of said fan body and permitting said fan body to be snappingly engaged to said misting device.

4. The combination fan and spray misting device according to claim 1, said releasable securing means further comprising at least one pair of bulbous end shaped portions projecting forwardly from said body of said misting device, at least one pair of rotatably configured slotted members being formed in a likewise spaced apart manner upon an associated rear face of said fan body, said slotted members each further including a first width portion as wide as said bulbous end shaped portions, a second constricted second portion and a third width portion, said bulbous end shaped portions being inserted within said first width portions and lockingly engaging within said narrowed width second and third portions of said slotted members upon said misting device being rotatably engaged relative to said fan.

5. The combination fan and spray misting device according to claim 1, said releasable securing means further comprising an intermediate clip portion interconnecting said fan to said spray misting device, said clip portion including a pair of bulbous end shaped portions projecting forwardly and being received within like configured apertures formed in an associated face of said fan body, said clip portion further including a pair of deflectable and engaging portions extending rearwardly which engage additional apertures formed within said spray misting device.

6. The combination fan and spray misting device according to claim 1, said spray misting device further comprising a first fluid carrying container and a second fluid carrying container extending in a substantially parallel manner, an elongated webbed portion interconnecting said first and said second fluid carrying containers.

7. The combination fan and spray misting device according to claim 6, said spray misting device further comprising a first spray button portion positioned atop said first fluid carrying container and a second spray button portion positioned atop said second fluid carrying container at an equal or greater vertical position relative to said first spray button portion.

8. The combination fan and spray misting device according to claim 1, said fan elongated body portion further comprising an interior cavity for holding at least one portable battery and said fan blade head portion further including an electric motor in operative engagement with said battery and said fan further having an on/off switch for selectively activating and deactivating said fan.

9. The combination fan and spray misting device according to claim 1, said fan elongated body portion further comprising a first fan body half portion and a second fan body half portion, said half portions being assembled together along tabbed portions.

10. The combination fan and spray misting device according to claim 1, further comprising an elongated flexible and fixedly repositionable neck portion interconnecting said fan body portion and said fan blade head portion.

11. The combination fan and spray misting device according to claim 6, said spray misting device further comprising a first spray button portion positioned a top said first fluid carrying container and a second lotion applicating portion positioned atop said second fluid carrying at an equal or greater vertical position relative to said first spray button.

12. A portable fan for use with a spray misting attachment, the misting attachment including a body capable of holding a volume of liquid and a spray applicator located atop said body, said fan comprising:

an elongated body portion and a fan head portion connected to said body portion and extending in an upwardly and angled manner relative to said body portion, said head portion including a plurality of rotatable blade elements mounted thereto; and releasable securing means arranged on said fan body for mounting said fan to the misting device so that said head portion is positioned forwardly of the spray applicator;

whereby an atomized mist spray produced by the spray applicator is cooled and distributed to a user by air currents generated by said fan head portion.

13. The portable fan as described in claim 12, said fan body further comprising an interiorly hollowed cavity, a battery power supply being incorporated within said elongated body portion, an electric battery likewise being incorporated within said body portion in a location relative to said fan head portion.

14. The portable fan as described in claim 12, said fan further comprising means for repositioning adjustment of said fan head portion relative to said body portion.

15. The portable fan as described in claim 14, said repositioning means further comprising an elongated and flexible neck portion interconnecting said body portion with said fan head portion, said neck portion supplying a flow of an electrical power source originating from said body portion to a portable electric motor located within said fan head portion to drive said plurality of rotatable blade elements.

* * * * *